United States Patent [19]

Miyakoshi et al.

[11] Patent Number: 4,549,510

[45] Date of Patent: Oct. 29, 1985

[54] ARRANGEMENT OF MULTIPLE VALVES FOR AN INTERNAL COMBUSTION ENGINE

[75] Inventors: Shinichi Miyakoshi, Fujimi; Naoto Hara, Tsurugashima, both of Japan

[73] Assignee: Honda Giken Kogyo Kabushiki Kaisha, Tokyo, Japan

[21] Appl. No.: 674,812

[22] Filed: Nov. 26, 1984

[30] Foreign Application Priority Data

Nov. 25, 1983 [JP] Japan ..... 58-220693
Dec. 9, 1983 [JP] Japan ..... 58-189178[U]
Dec. 14, 1983 [JP] Japan ..... 58-234381

[51] Int. Cl.[4] ..... F01L 1/02; F02B 15/00

[52] U.S. Cl. ..... 123/90.27; 123/90.41; 123/90.44; 123/432

[58] Field of Search ..... 123/90.27, 90.41, 90.44, 123/308, 432, 52 M

[56] References Cited

U.S. PATENT DOCUMENTS 1,484,376 2/1924 Lanzerotti-Spina ..... 123/90.22
2,144,561 1/1939 Buchi ..... 123/308
2,710,602 6/1955 Maybach et al. ..... 123/41.76
3,139,870 7/1964 Sampietro ..... 123/90.41
3,211,137 10/1965 Love ..... 123/188 M

FOREIGN PATENT DOCUMENTS 57-183553 11/1982 Japan .
123658 3/1919 United Kingdom ..... 123/90.41
242919 11/1925 United Kingdom ..... 123/90.41

*Primary Examiner*—E. Rollins Cross
*Attorney, Agent, or Firm*—Armstrong, Nikaido, Marmelstein & Kubovcik

[57] ABSTRACT

Three intake and two exhaust valves are arranged on a single circumferential line around the center of the combustion chamber with the longitudinal axes of the valves crossing at a single point on the longitudinal axis of the cylinder. An ignition plug is provided in the space between the two exhaust valves and is angled so that its forward end is directed towards the center of the combustion chamber. A single common cam shaft is provided horizontally at an intermediate position of the cylinder head between the intake valves and the exhaust valves.

4 Claims, 12 Drawing Figures

ARRANGEMENT OF MULTIPLE VALVES FOR AN INTERNAL COMBUSTION ENGINE

BACKGROUND OF THE INVENTION

This invention relates to a multiple-valve internal combustion engine for a motorized two-wheeled vehicle or the like wherein three intake valves and two exhaust valves are provided for a common cylinder.

Engines of this kind, having multiple valves are known such as the one shown in FIGS. 1 and 2 and disclosed, for instance, in Japanese Unexamined Patent Application Publication No. Sho 57-183553. In such an engine, the cylinder head a is provided with two intake valves c, c at its portion on one side on a circumference surrounding the center line of a combustion chamber b and with two exhaust valves d, d at its portion on the other side on the same circumference. In addition, another intake valve c is provided at its portion on the center line of the combustion chamber b. The engine is provided with the three intake valves c, c, c in total for improving the output thereof.

This engine, however, has the disadvantage that, because of the arrangement that the third intake valve c is provided at the center position of the cylinder head s, the position for providing an ignition plug e has to be deviated radially from the center position. In order to obtain uniform combustion, a pair of ignition plugs e have to be disposed on both outsides of the center position. This arrangement is troublesome. In addition, for avoiding interference with the ignition plugs e, e, a pair of cam shafts f, f have to be horizontally disposed on both lateral outsides of a disposition section of the ignition pliug e, e. Thus, it cannot be avoided that the engine is formed into a so called "DOHC" type which is disadvantageous. Additionally, this type is also inconvenient in that, due to the arrangement that those valves are disposed so that the intake valves may be in parallel one with another in their inclined lines and the exhaust valves may be in parallel one with another in their inclined axial lines, the end surfaces of the respective valves crossing at right angles to their respective stepped shoulders protruded from a top surface wall of the combustion chamber. This forms the upper surface wall of the combustion chamber into a rugged surface which is liable to cause an ununiform combustion resulting in lowering in the combustibility.

There has been also known an engine, as disclosed in U.S. Pat. No. 2,710,602, for instance, wherein the cylinder head in provided at its portion on one side on the circumference surrounding the center line of the combustion chamber with three intake valves and at its portion on the other side on the circumference with two exhaust valves. A single ignition plug is provided at its portion on the center line of the combustion chamber.

This type of engine, however, is also inconvenient in that, because the ignition plug is provided vertically along the center line of the cylinder, the engine is required to be formed into a DOHC type in order to avoid interference with those valves. Additionally, due to such arrangement that the top wall surface of the combustion chamber is formed into a horizontal place crossing at right angles the axial line of the cylinder and the respective valves are all provided vertically in parallel with the cylinder axial line, the cylinder must be enlarged in its bore diameter from a view-point of layout of the valves.

OBJECT AND SUMMARY OF THE INVENTION

This invention has for its object to provide a multiple-valve internal combustion engine free from the foregoing inconveniences.

These problems are avoided in an engine having three intake valves and two exhaust valves provided for a common cylinder, characterized in that the three intake valves disposed in the cylinder head are positioned on one side on the circumference surrounding a center line of a combustion chamber thereof and the two exhaust valves are positioned on the other side thereon in a radial disposition such that the longitudinal axes of those valves cross one another at a point on the longitudinal axis of the cylinder. The ignition plug is provided in the cylinder head in a space between the two exhaust valves and is inserted through the cylinder head in an inclined posture such that its forward end is directed toward the center of the combustion chamber. A single common cam shaft is provided horizontally at an intermediate position of the cylinder head between the intake valve disposition section and the exhaust valve disposition section so that the respective valves may be driven by the cam shaft.

DETAILED DESCRIPTION OF PREFERRED EMBODIMENTS

Figure 1:
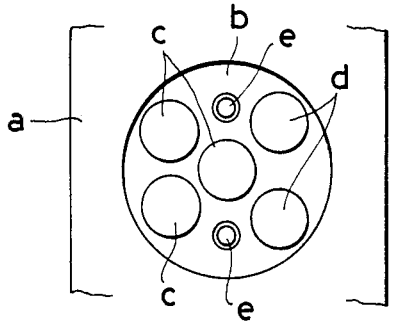
FIG. 1 is a top plan view of a conventional multiple-valve internal combustion engine.
Figure 2:
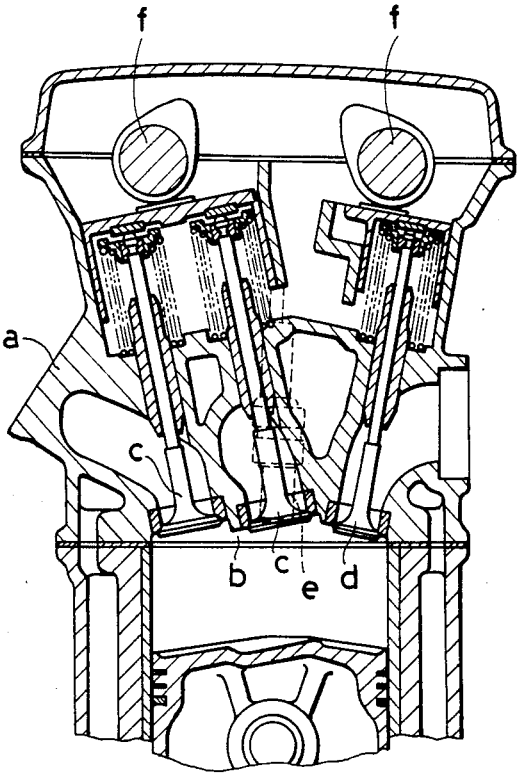
FIG. 2 is a sectional side view thereof.
Figure 3:
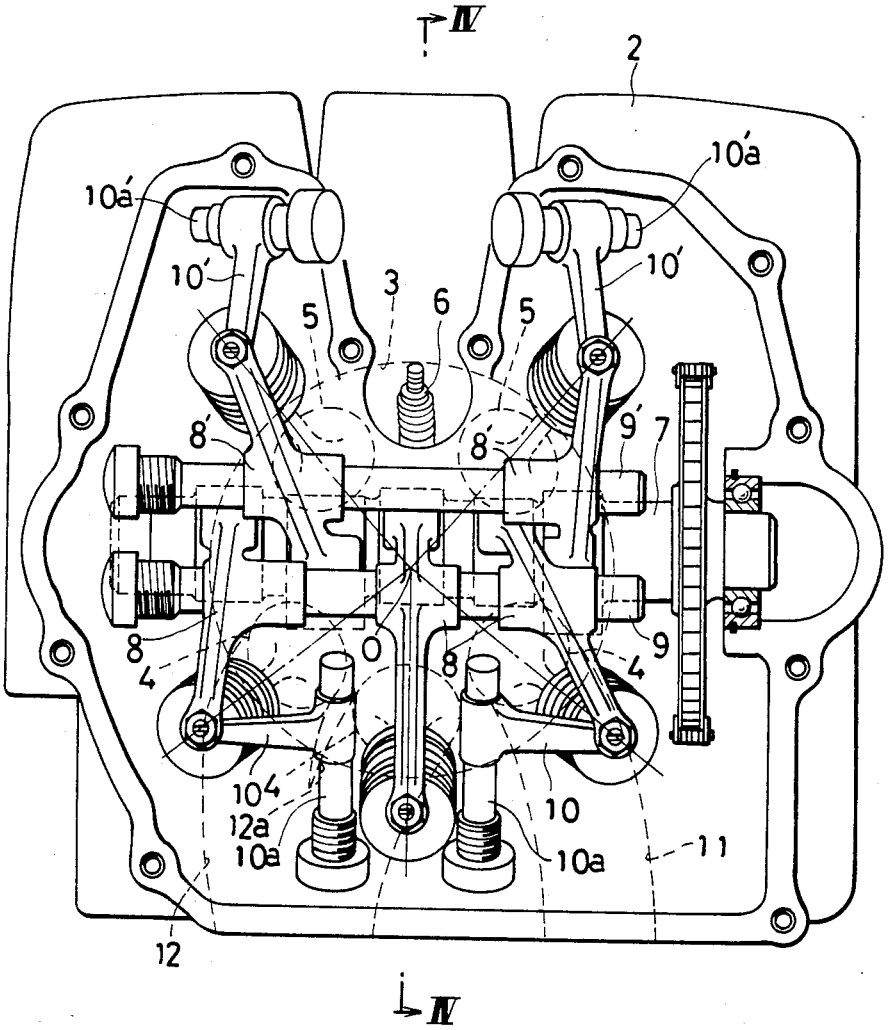
FIG. 3 is a top plan view of a cylinder head portion of one example of the present invention.
Figure 4:
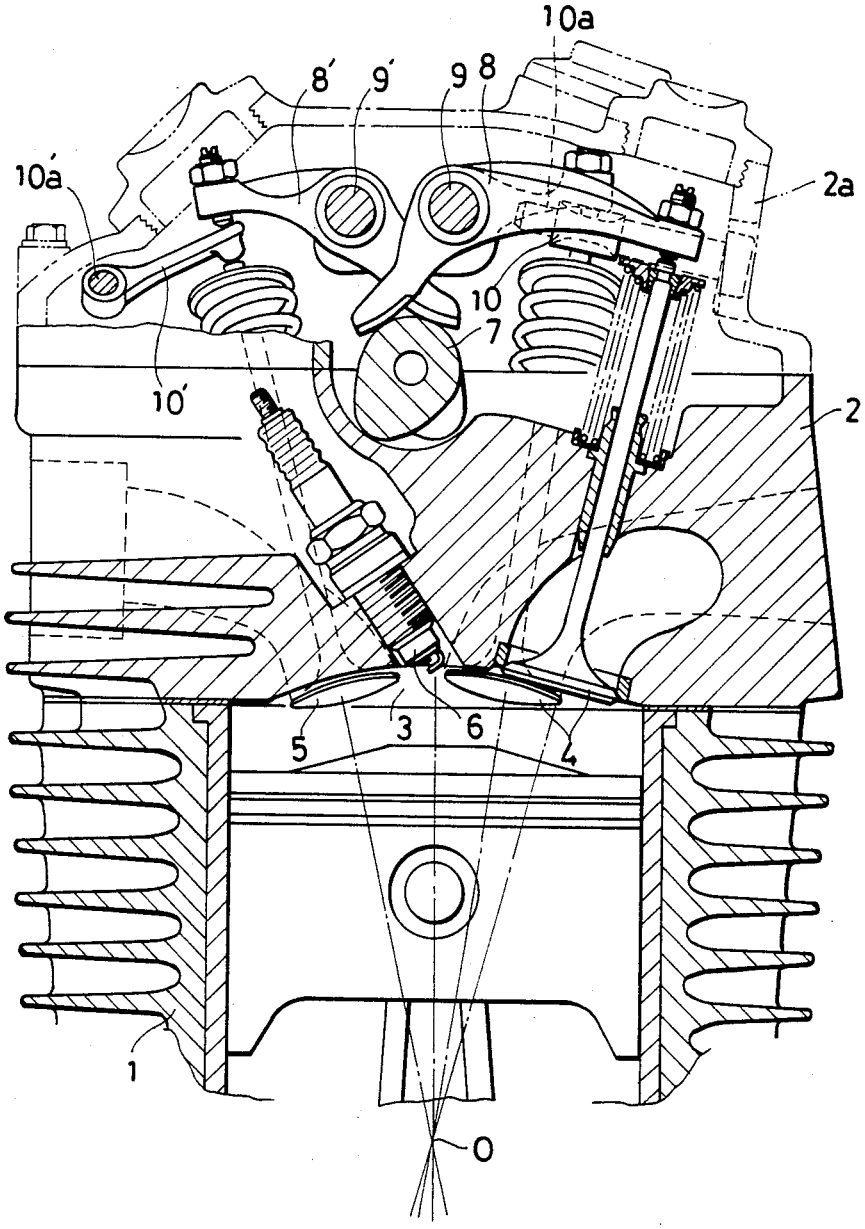
FIG. 4 is a sectional view taken along the line IV—IV in FIG. 3.

Embodying examples of this invention will now be explained with reference to the accompanying drawings:

Referring to FIGS. 3 and 4, a cylinder 1 has thereon a cylinder head 2 with a cylinder head cover 2*a*. The cylinder head 2 is provided at its portion on one side on the circumference surrounding a center line of a combustion chamber 3 thereof, for instance, on a rear side portion on the circumference, with three intake valves 4, 4, 4, and at its portion on the other side on the circumference, for instance, on a front side portion thereof, with two exhaust valves 5, 5, in such a manner that these valves 4, 4, 4, 5, 5 are disposed radially with their longitudinal axes crossing one another at a point O on the longitudinal axis of the cylinder 1. In addition, the cylinder head 2 is provided with an ignition plug 6 in a space between the two exhaust valves 5, 5, in such a manner that the plug 6 is inserted through the cylinder head 2 so that its front end is directed toward the center point O of the combustion chamber 3.

Due to this arrangement, a top wall surface of the combustion chamber 3 can be formed into a stepless and even spherical surface with a center of a curvature thereof at the foregoing point O. There is formed on the cylinder head 2, a space in which the ignition plug 6 does not exist between the rear side disposition section bearing the intake valves 4, 4, 4 and the front side disposition section bearing the exhaust valves 5, 5. A single common cam shaft 7 can be horizontally provided in that space so as to make a SOHC type engine where the respective valves 4, 4, 4, 5, 5 are driven by the single cam shaft 7.

An interlocking mechanism between the cam shaft 7 and the respective valves 4, 4, 4, 5, 5 is constructed so that a rocker arm shaft 9 for the intake valves supporting three rocker arms 8, 8, 8 and a rocker arm shaft 9' for the exhaust valves supporting two rocker arms 8', 8' are provided above the cam shaft 7 and in parallel therewith so that the respective valves 4, 4, 4, and 5, 5 may be driven by the cam shaft 7 through the respective rocker arms 8, 8, 8 and 8', 8'.

In this case, the longitudinal axis of the middle intake valve 4 out of the three intake valves 4, 4, 4, is positioned on a plane crossing at right angles with the rocker arm shaft 9. The longitudinal axes of the right and left side intake valves 4, 4 and the longitudinal axes of the exhaust valves 5, 5 are not positioned to be in coincidence with respective planes crossing at right angles the respective rocker arm shafts 9 and 9'. Accordingly, these valves 4, 4 and 5, 5 on both sides are so arranged as to be driven through the respective rocker arms 8, 8 and 8', 8' and respective sub-rocker arms 10, 10 and 10', 10' supported on respective shafts 10*a*, 10*a* and 10*a'*, 10*a'* which cross at right angles to the longitudinal axes of respective valves 4, 4, 5, 5 so as to be swung to move along the directions of the longitudinal axes of the respective valves 4, 4 and 5, 5.

If, however, the sub-rocker arms 10, 10, 10', 10' are thus employed, there are involved such inconveniences that the number of parts is increased, the weight of the valve driving system is increased, and the space volume for a cylinder head section is enlarged. Accordingly, it is desirable that the intake valves 4, 4 on both sides and the exhaust valves 5, 5 can be driven, without using the foregoing sub-rocker arms 10, 10, 10', 10'.

Figure 5:
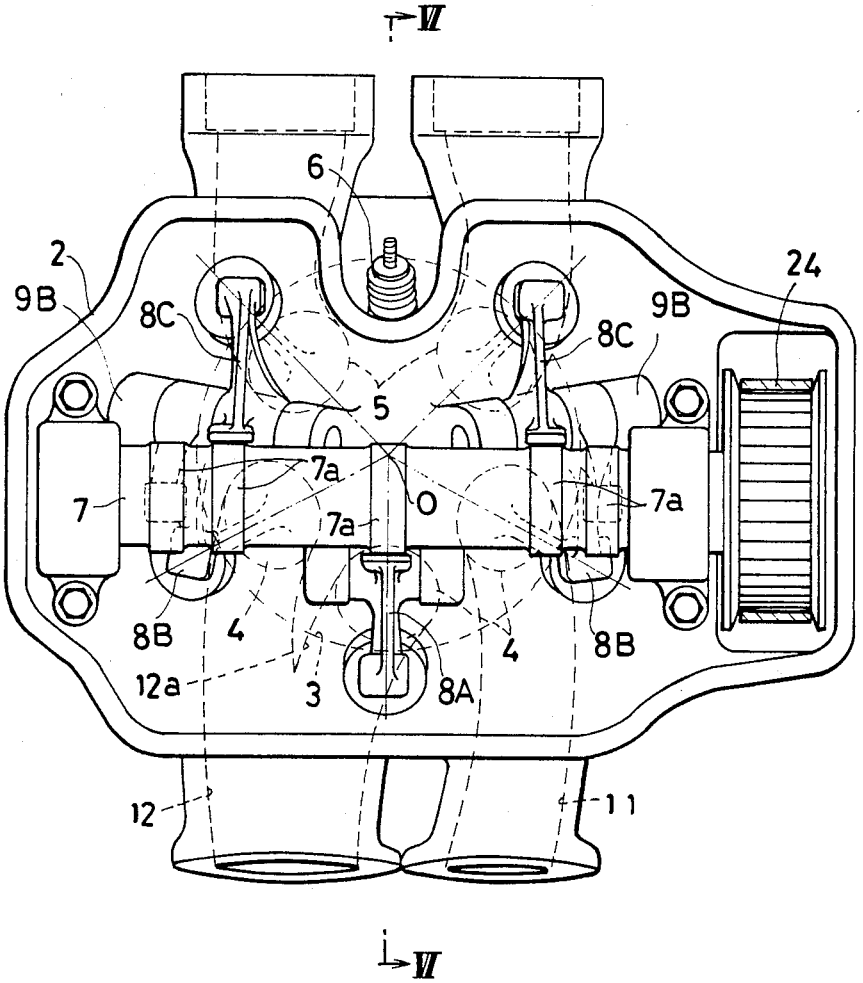
FIG. 5 is a top plan view of a cylinder head portion of another embodying example of the present invention.
Figure 6:
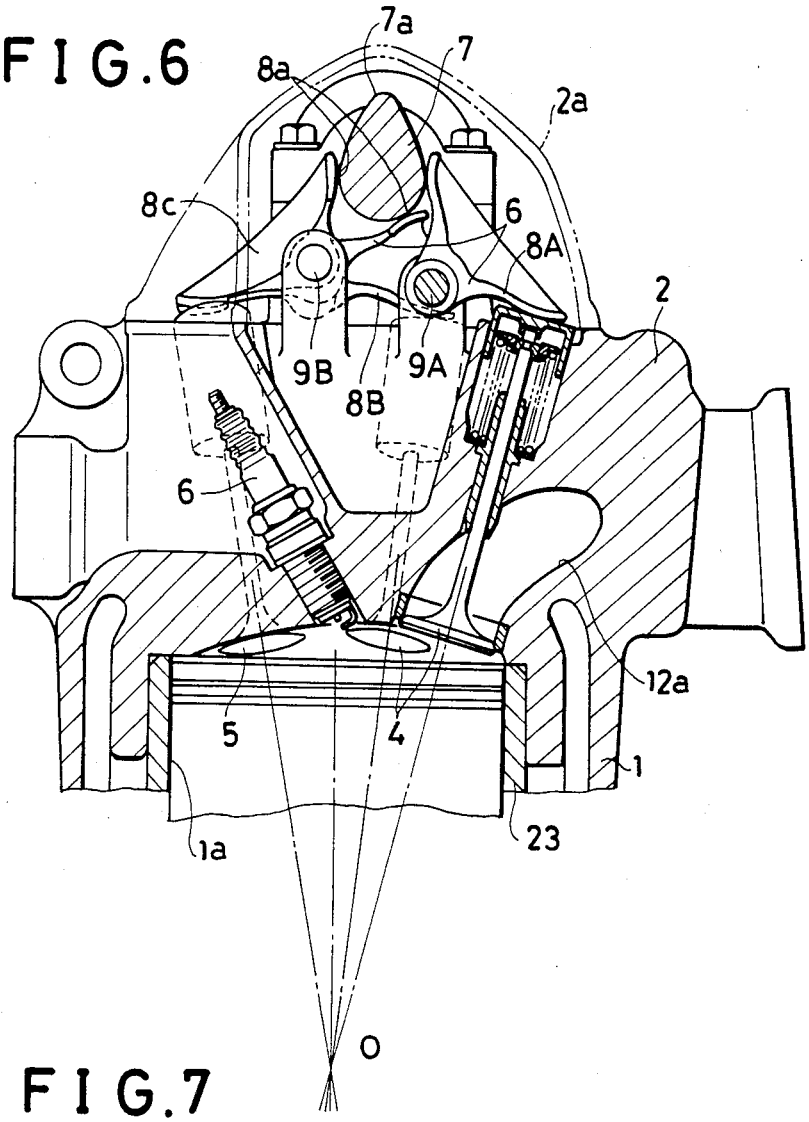
FIG. 6 is a sectional view taken along the line VI—VI in FIG. 5.

FIGS. 5 and 6 show an embodying example of this invention meeting this desire.

The intake valve 4 in the middle position is arranged to be driven through a rocker arm 8A supported on a rocker arm shaft 9A provided in parallel with the cam shaft 7. In addition, a pair of right and left rocker arm shafts 9B, 9B are so disposed that each thereof crosses at right angles each triangular plane defined by the longitudinal axes of the intake valve 4 and that of the exhaust valve 5 which are adjacent one with another in front and rear relationship on each of both the right and left side, with its apex at the crossing point O of the two longitudinal axes. Each pair of the two pair of rocker arms 8B, 8B, 8C, 8C for driving each corresponding intake valve 4 in rear and the exhaust valve 5 in front of each side are supported on each of the pair of rocker arm shafts 9B, 9B. By this arrangement, the pair of rocker arms 8B, 8C supported on each shaft 9B can be so driven by the cam shaft 7 as to swing in the direction which is the same as the longitudinal axes of the respective intake and exhaust valves 4, 5 such that define the foregoing triangular plane. Thus the mutually adjacent intake and exhaust valves 4, 5 on each side can be given reliable opening and closing operations, without using sub-rocker arms.

Even if, in this case, the rocker arm shaft 9B is inclined in relation to the cam shaft 7, there is no problem in practical use, if each lobe 7*a* on the cam shaft 7 is formed into one having a three dimensionally curved cam profile so that slipper surface 8*a* of each of the rocker arms 8B, 8C may be brought in line contact with each corresponding cam 7*a*. In any of the foregoing examples, a first intake passage 11 connected to the single intake valve 4 on one side (on the right side in the drawings) and a second intake passage 12 diverged into two and connected to the remainder two intake valves 4, 4 are disposed side by side. It is arranged so that an intake operation may be carried out through both the two intake passages 11, 12 in a high speed range of the engine, but an intake operation through the second intake passage 12 may be stopped and an intake operation through the first intake passage 11 along may be carried out in a middle and low speed range of the engine.

The changeover between the foregoing two intake operation conditions can be carried out, for instance, by using individual carburetors (not illustrated) connected to the respective intake passage 11, 12. The carburetor connected to the second intake passage 12 ceases operation when the engine speed falls in the middle and low speed range.

For this changeover operation, though not illustrated, the carburetor connected to the second intake passage 12 is formed into a piston valve type having a piston valve that opens and closes, interlocking with an acceleration grip (in the case of a motorcycle), as disclosed, for instance, in U.S. patent application Ser. No. 465,716.

With this arrangement, in the middle and low speed range, gas mixture flows into the combustion chamber 3, while being swirled circumferentially, at a high speed, from the one side single intake valve 4 alone connected to the first intake passage 11. The swirling effect improves combustibility to increase the output of the engine. In the high speed range, a large amount of gas mixture flows thereinto through all three intake valves 4, 4, 4, and thereby the intake and exhaust efficiency can be hightened to increase the output of the engine.

It is desirable, in this case, that the sectional area of the first intake passage 11 and the sectional area of each diverged passage of the second intake passage 12 are made equal to one another in order to supply to each of the three intake valves 4, 4, 4 a uniform amount of gas mixture.

In the conventional multiple-valve engine of the type having three intake valves, there has been hitherto known such an arrangement that two intake passages connected respectively to two intake valves on both outsides are connected to an intake valve in the middle through their respective diverged passages. In these arrangement, however, even if the intake operation through one of the intake passages is suspended in a middle and low speed range, a gas mixture flows into the combustion chamber through all the intake valves, due to the fact that the two intake passages are interconnected through the diverged passages, and thus an effect caused by the stop of the intake operation cannot be fully exhibited. There cannot be obtained such an operation and an effect as caused by the foregoing examples of the invention.

Figure 7:
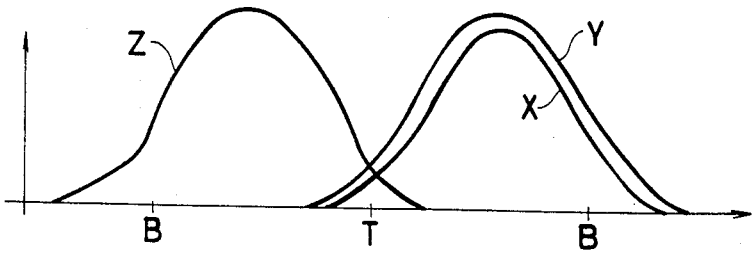
FIG. 7 is a diagram showing a valve timing thereof.
Figure 8:
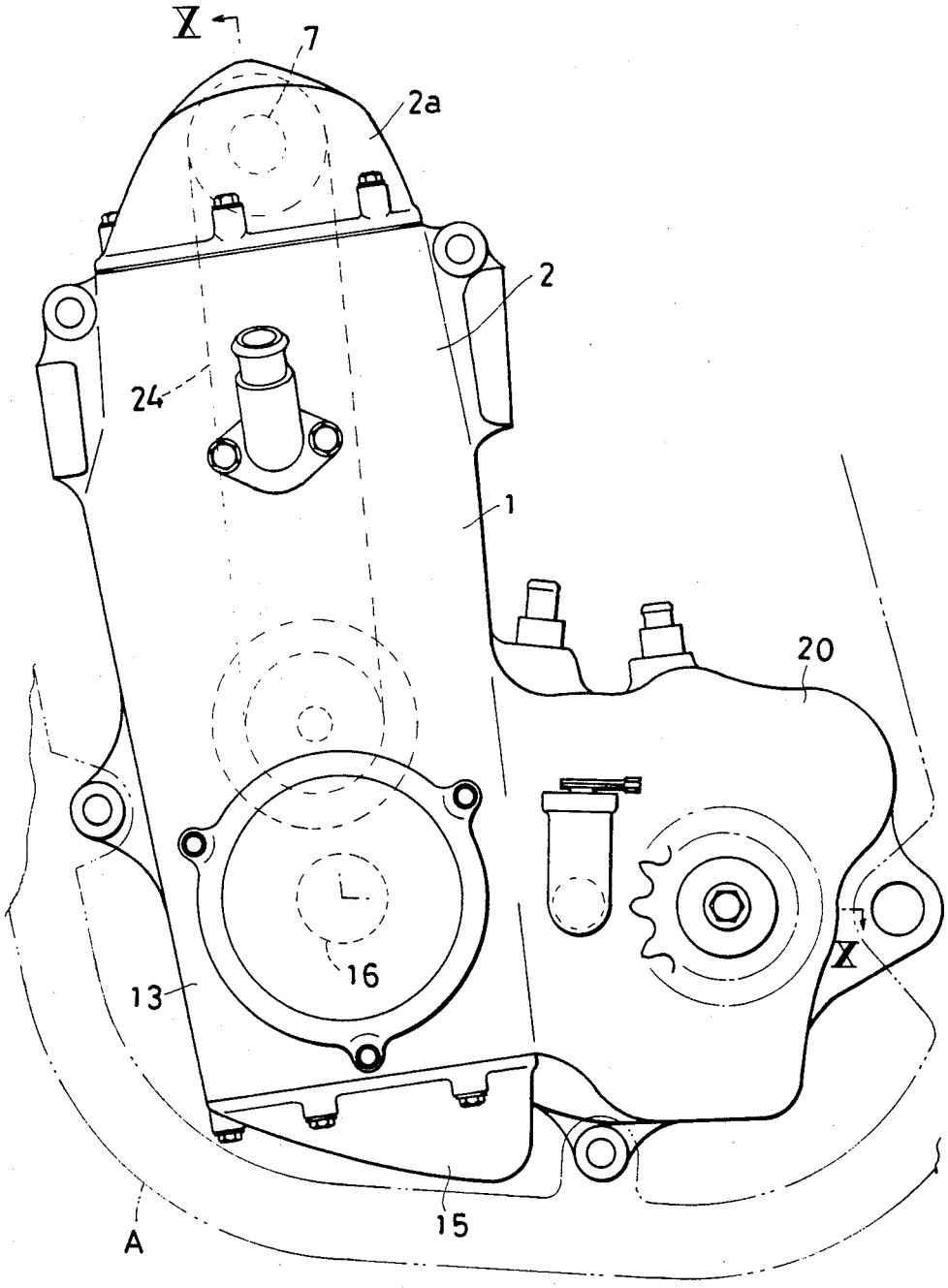
FIG. 8 is a side view of the whole of the engine of the embodying example shown in FIG. 5.
Figure 9:
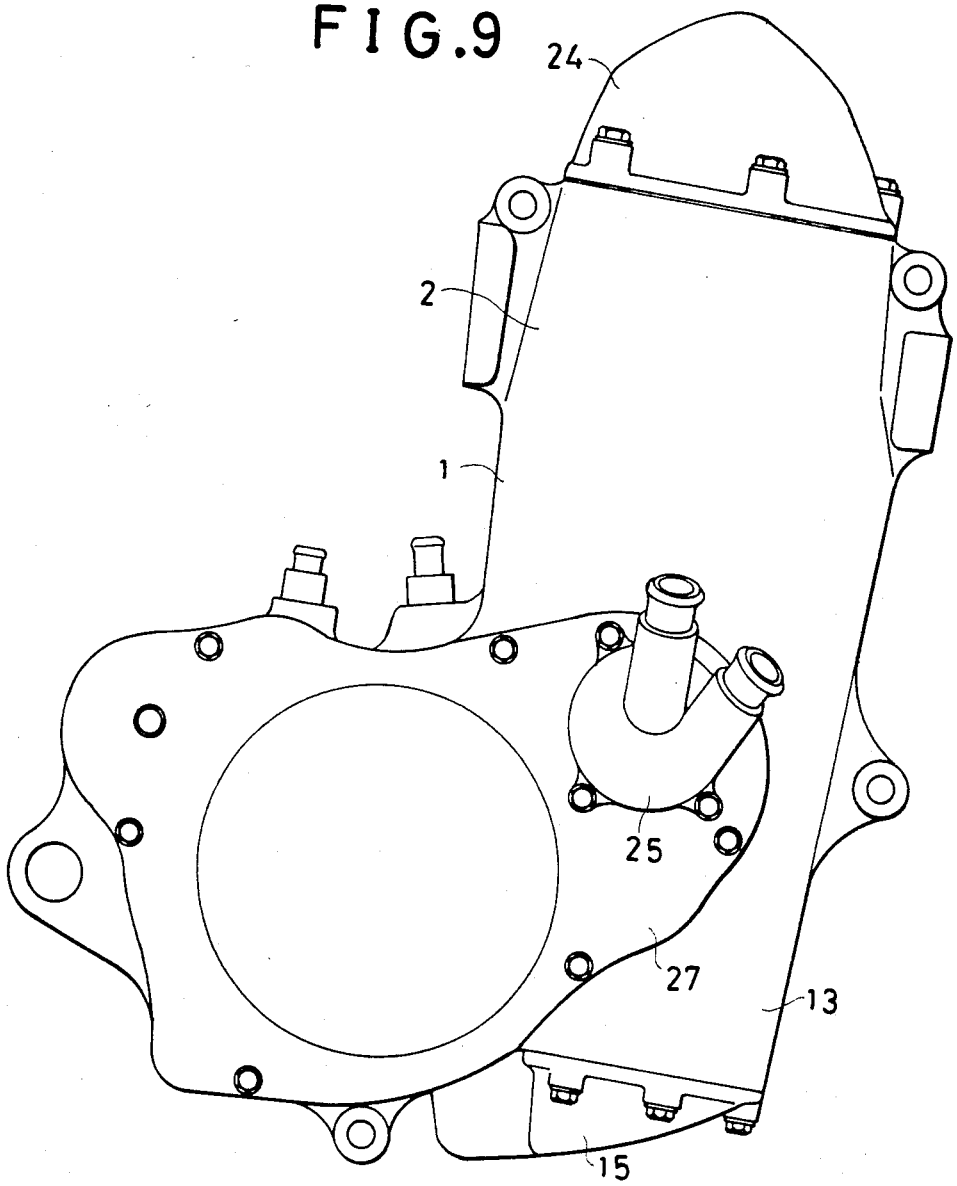
FIG. 9 is a side view as viewed from the opposite side of the same.
Figure 10:
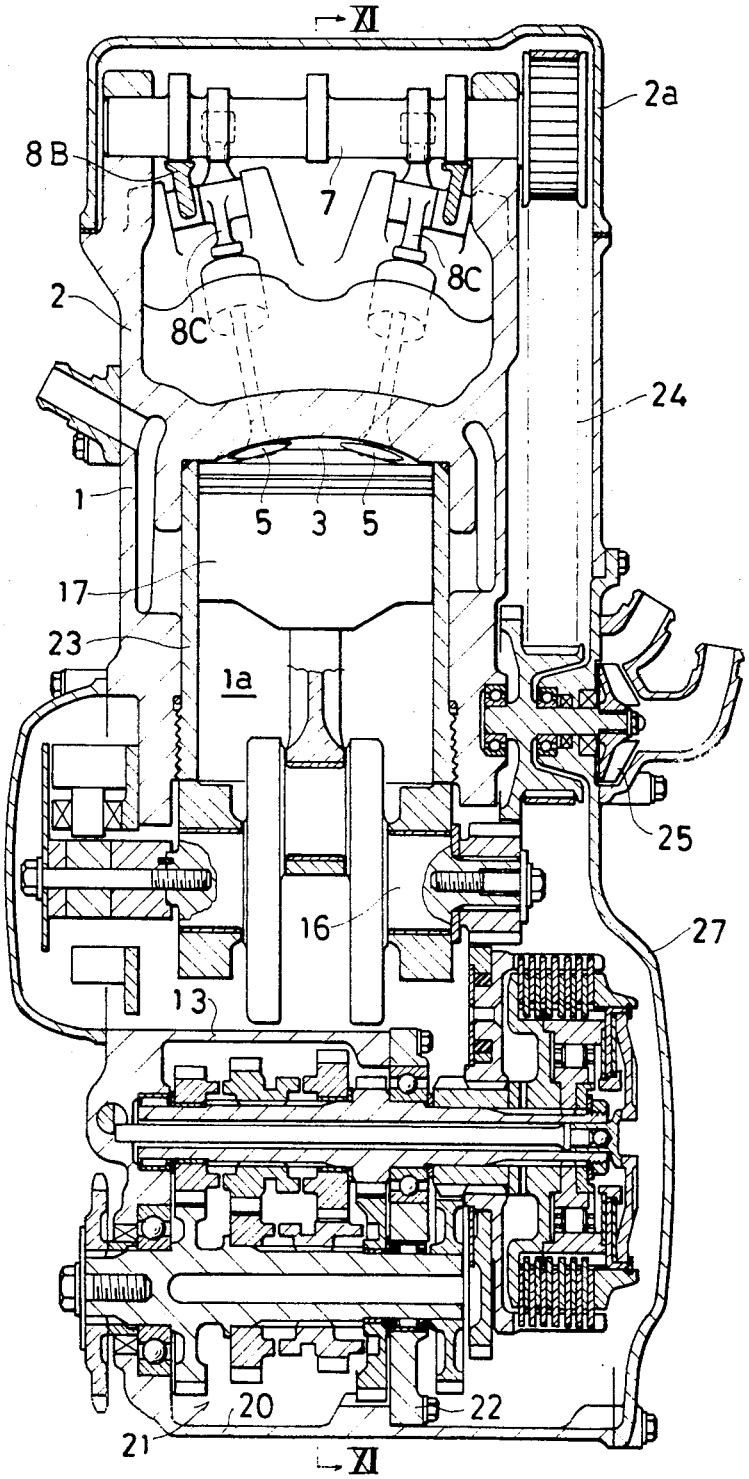
FIG. 10 is a sectional view taken along the line X—X in FIG. 8.

Further, by the foregoing arrangement of this invention, unlike the conventional apparatus wherein the two intake passages are interconnected, the intake valve 4 connected to the first intake passage 11 and two intake valves 4, 4 connected to the second intake passage 12 can be independently set in valve timing as shown, for instance, in FIG. 7. The intake system including the first intake passage 11 and the intake system including the second intake passage 12 can be properly used for different purposes. In FIG. 7, a curve X shows an operation characteristic of the intake valve 4 connected to the first intake passage 11, a curve Y shows an operation characteristic of the intake valve 4 connected to the second intake passage 12, and a curve Z shows an operation characteristic of the exhaust valve 5. In this case, the open valve range of the intake valve 4 connected to the first intake passage 11 is made narrower than that of the intake valve 4, 4 connected to the second intake passage 12, whereby the idle stability and the idle setting can be facilitated. In the same Figure, T denotes a top dead center and B denotes a bottom dead center.

Figure 11:
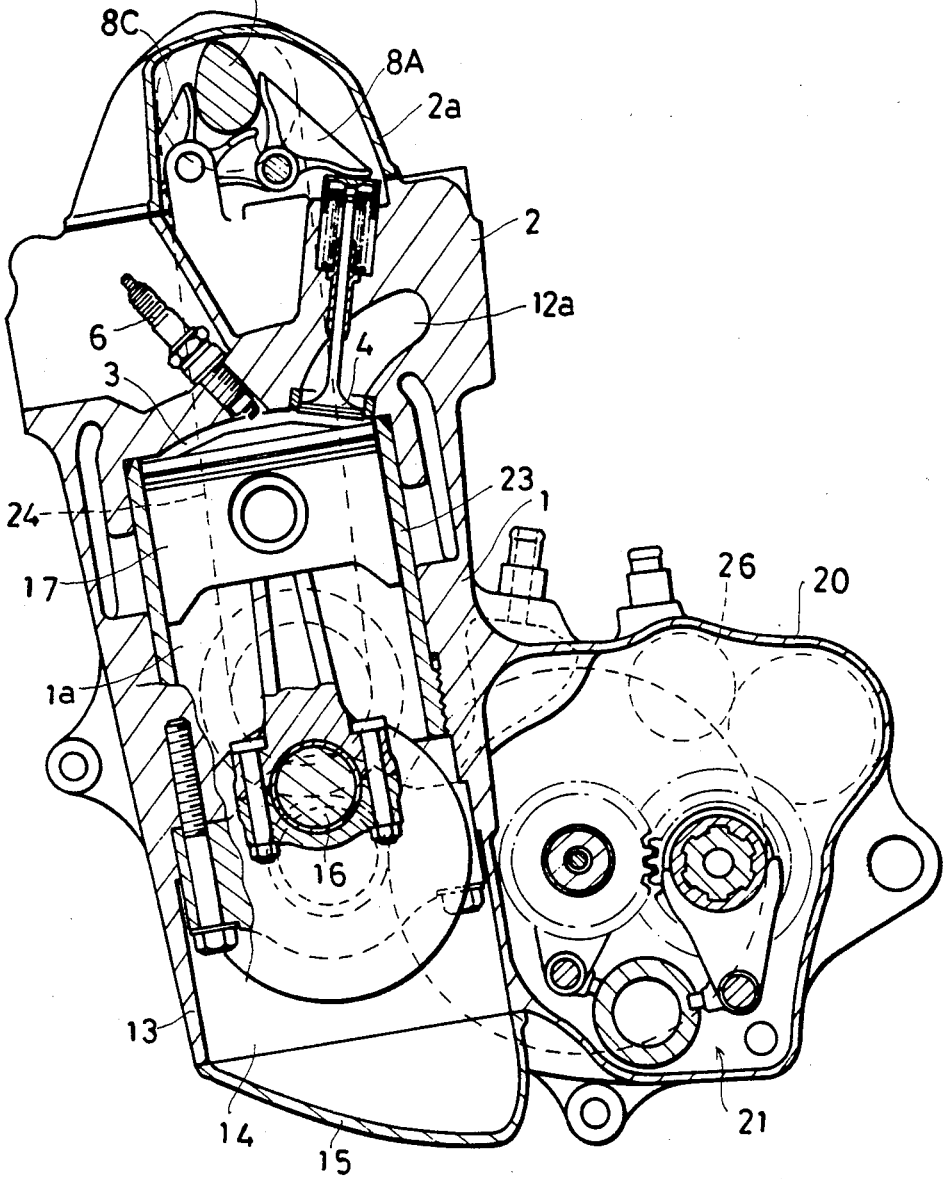
FIG. 11 is a sectional view taken along the line XI—XI in FIG. 10.

The foregoing embodying example shown in FIGS. 5 and 6 is applied to a monoblock engine, that is, a cast product engine of magnesium alloy or the like having an integrally molded engine body throughout the whole thereof ranging from the cylinder head 2 through the cylinder 1 to a crankcase 13. In this case (FIGS. 8–11), the crankcase 13 is provided at its lower surface with an opening 14 made in the crankcase 13 on casting to face a bore 1*a* of the cylinder 1. An oil pan 15 is detachably applied to the opening 14 so that, at the time of assembly and disassembly of the engine, an assembly comprising a crankshaft 16 and a piston 16 combined therewith may be detachably mounted in the engine body through the opening 14 by detaching the oil pan 15 (FIG. 11).

Figure 12:
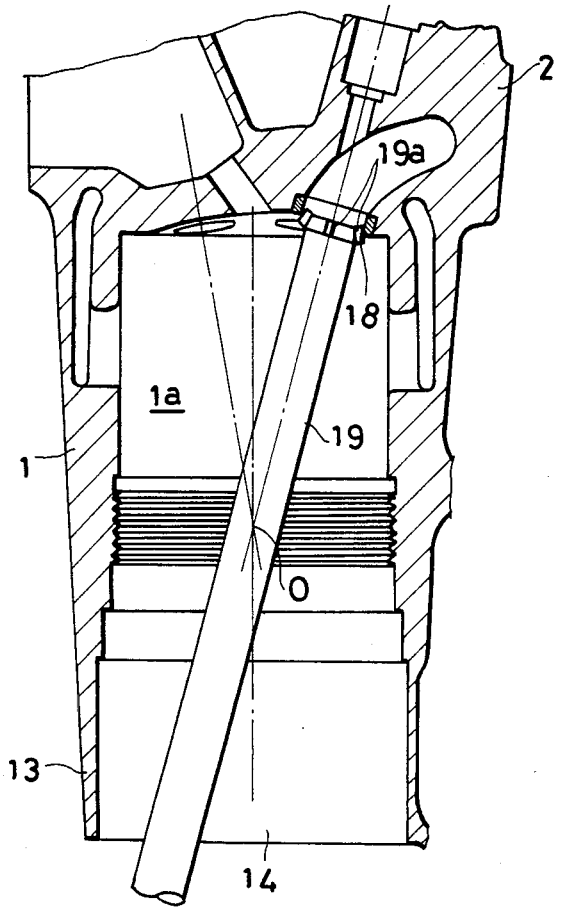
FIG. 12 is a sectional side view of an important portion thereof for explaining a working of a valve seat surface thereof.

This monoblock type engine is different from an engine of the type that cylinder head thereof is formed separately from a cylinder, especially in that each valve seat surface 18 is given a finishing work on a combustion chamber wall of the head 2 is considered to become difficult. If, however, the intake and exhaust valves 4, 4, 4, 5, 5 are so disposed radially that their longitudinal axes cross each other at the point O on the longitudinal axis of the cylinder 1 as mentioned above, and at the same time longitudinal axes of the valves 4, 4, 4, 5, 5 are so arranged as to pass through the opening 14, each valve seat surface 18 can be worked simply by the way that, as shown in FIG. 12, a spot facing cutter tool 19 having at its forward end a cutting bit 19*a* for applying a grinding work to each valve seat surface 18 for each of those valves 4, 4, 4, 5, 5 is inserted through the opening 14. Namely, because every valve longitudinal axis passes through the opening 14, the tool 19 can be inserted into the engine body through the opening 14 along on the valve axis of any desired valve seat surface 18 to be worked and thereby a precise working on the valve seat surface 18 can be effected. In addition, because the valve axes cross each other at the common point O on the axis of the cylinder 1, if the tool 19 is swung about the point O in relation to the cylinder head 2 so that the axis thereof may be brought to be in coincidence with the axis of each of the valve seat surfaces 18 on after another, all the valve seat surfaces 18, 18, 18, 18, 18 can be worked thereby evenly at a high accuracy.

The foregoing monoblock engine is adapted to be mounted on a vehicle body A of a motorized two-wheeled vehicle, and a transmission casing 20 extending rearwards from the crankcase 13 is formed integrally with the engine body. One side surface thereof is formed as an open surface for accepting a transmission mechanism 21 so that the transmission mechanism 21 combined with a transmission holder 22 serving to close the open surface may be mounted in the transmission casing 20 trough the open surface.

Referring to the drawings, a cylinder liner 23 can be mounted, in threaded engagement relations, in the bore 1*a* of the cylinder 1. Numeral 24 denotes a driving belt for the cam shaft 7, numeral 25 denotes a water pump, numeral 26 denotes an oil pump, and numeral 27 denotes a side cover attached detachably to one side surface of the engine body including the crankcase 13.

Thus, according to this invention, three intake valves and two exhaust valves are so disposed radially that the former are positioned on one side on the circumference surrounding the center line of a combustion chamber and the latter are positioned on the other side thereon, and an ignition plug is positioned in a space between the two exhaust valves and is so provided in such an inclined posture that a forward end thereof may direct toward the center of the combustion chamber, so that an upper wall surface of the combustion chamber may be formed into a concaved spherical surface of small unevenness to improve the combustion property, so that a cam shaft can be provided, without causing any interference thereof with the ignition plug, at an intermediate position between the intake valve disposition section and the exhaust valve disposition section, and thereby there can be obtained a multiple-valve engine of SOHC type wherein the cam shaft serves a single common one. This causes such advantages that the engine can be made small in size and weight.

It is readily apparent that the above-described arrangement of multiple valves for an internal combustion engine meets all of the objects mentioned above and also has the advantage of wide commercial utility. It should be understood that the specific form of the invention hereinabove described in intended to be representative only, as certain modifications within the scope of these teachings will be apparent to those skilled in the art.

Accordingly, reference should be made to the following claims in determining the full scope of the invention.

What is claimed is:

1. A multiple-valve internal combustion engine having three intake valves and two exhaust valves provided for a common cylinder, characterized in that the three intake valves and the two exhaust valves are disposed in a cylinder head thereof with the intake valves positioned on one side on a circumference surrounding a center line of a combustion chamber thereof and the exhaust valves positioned on the other side thereon in a radial disposition wherein longitudinal axes all valves cross one another at a point on a longitudinal axis of the cylinder, and an ignition plug is provided in a space between the two exhaust valves and is inserted through the cylinder head in an inclined posture with a forward end thereof directed toward the center of the combustion chamber, and a single common cam shaft is provided horizontally at an intermediate position of the cylinder head between a disposition section of the intake valves and a disposition section of the exhaust valves so that the respective valves may be driven by the common shaft.

2. A multiple-valve internal combustion engine as claimed in claim 1, wherein the intake valve positioned in the middle of the intake valve disposition section is so provided that the longitudinal axis thereof is positioned on a plane crossing at right angles to a longitudinal axis of the common cam shaft and is arranged to be driven through a rocker arm supported on a rocker arm shaft provided in parallel with the cam shaft, and a pair of rocker arm shafts on both sides are disposed to cross at right angles to a triangular plane on each side defined by the longitudinal axis of each of the two intake valves positioned on both sides in the intake valve disposition section and the longitudinal axis of each of the two exhaust valves with the apex thereof at the intersection point of the foregoing two longitudinal axes, and each pair of rocker arms for driving the intake valve and the exhaust valve on each side are supported on each of the pair of rocker arm shafts.

3. A multiple-valve internal combustion engine as claimed in claim 1, wherein a first intake passage connected to the intake valve on one side in the intake valve disposition section and a second intake passage diverged into two and connected to the remaining two intake valves are provided, side by side, in the cylinder head, and these passages are so arranged that an intake operation is carried out through the two intake passages in a high speed range of the engine, and an intake operation through the second intake passage is stopped at a middle and low speed range of the engine.

4. A multiple-valve internal combustion engine as claimed in claim 1, wherein an engine body is a monoblock body integrally formed throughout the whole including a cylinder head, the cylinder, and a crankcase, and the crankcase is provided at its lower surface with an opening positioned so that the axial lines of the intake valves and those of the exhaust valves may pass through the opening.

* * * * *